US006242706B1

(12) United States Patent
Miyata

(10) Patent No.: US 6,242,706 B1
(45) Date of Patent: Jun. 5, 2001

(54) MICROSWITCH

(75) Inventor: Munechika Miyata, Tokyo (JP)

(73) Assignee: Mic Enterprise Co., Ltd., Tokyo (JP)

( * ) Notice: Subject to any disclaimer, the term of this patent is extended or adjusted under 35 U.S.C. 154(b) by 0 days.

(21) Appl. No.: 09/500,905

(22) Filed: Feb. 9, 2000

(30) Foreign Application Priority Data

Mar. 23, 1999 (JP) ..... 11-077338

(51) Int. Cl.[7] ..... H01H 21/80

(52) U.S. Cl. ..... 200/537; 200/558; 200/573; 200/6 R; 200/6 B

(58) Field of Search ..... 200/6 R–6 C, 200/16 R, 16 C, 520, 533, 537, 553, 558, 559, 573, 574, 341

(56) References Cited

U.S. PATENT DOCUMENTS 4,408,105 * 10/1983 Tanaka ..... 200/68
4,654,487 * 3/1987 Sawada ..... 200/1 V
4,874,911 * 10/1989 Parrish ..... 200/6 R
4,978,823 * 12/1990 Sato et al. ..... 200/437
5,660,270 * 8/1997 Martin et al. ..... 200/315

* cited by examiner

*Primary Examiner*—Michael Friedhofer
(74) *Attorney, Agent, or Firm*—Oblon, Spivak, McClelland, Maier & Neustadt, P.C.

(57) ABSTRACT

A microswitch is provided with a push lever having a ball at a lower end so as to roll freely. A seesaw contact piece has one side piece to which a movable contact is attached and an opposite side piece to which the ball of the push lever is in constant contact when external force is not applied to the push lever. A fixed contact switches ON by coming into contact with the movable contact and switches OFF by separating from the movable contact. A fixed contact piece is configured to support a comer part of the seesaw contact piece.

7 Claims, 4 Drawing Sheets

MICROSWITCH

BACKGROUND OF THE INVENTION

1. Field of the Invention

This invention provides a microswitch which can be switched by loading a projection of a push lever projecting outside a case with external force or releasing the external force therefrom and which has general-purpose properties for an operation, a detection and so on of a wide variety of apparatuses.

2. Description of the Prior Art

A conventional microswitch which has been generally and widely used is constructed so that one end of a contact spring piece comprising a tension member and a compression member is fixed in a small box-shaped case (common terminal) and the other end is provided with a movable contact, said movable contact being provided opposite a fixed contact (terminal) (separately therefrom or coming into contact therewith), the above-described contact spring piece is pressed and inverted by pressing and descending an actuator, for example, a press button, the contact spring piece is reversed and inverted (snap action) at a given pressing point and contact of the movable contact with the fixed spring (ON) or separation of the movable contact from the fixed spring (OFF) is performed instantly. However, in case of the above-described conventional microswitch, not only has it been difficult to produce the contact spring piece comprising the tension member and the compression member precisely without scatter in each switch for manufacturing processing technique, material and so on with miniaturization of the switch, but also the precision in mounting technique for mounting the microswitch to a case has been at the end of its limitation and, particularly, it has not been possible to correspond to the recent super-miniaturization, for example, each dimension of longitude, side and height is proximately 10 mm, and there has been a problem that cost rises inevitably because of miniaturization and improvement in precision.

Furthermore, since the contact (ON) pressure of the movable contact with fixed contact which are important points for a switch operation is only spring pressure of a small contact spring piece, there occurs scatter in the contact pressure for every switch operation, thereby making the switch performance unstable. Also, there has been a problem that the switch performance deteriorates because of dirt on a contact part after long-term use, repeated use and so on.

SUMMARY OF THE INVENTION

This invention comprises as main members a push lever and a seesaw contact piece which can be easily miniaturized and sophisticated in high-precision and realizes miniaturization of a switch and cost reduction and, simultaneously, performs simply but precisely switch operation, that is to say, operations of a movable contact and a fixed contact by means of the seesaw contact piece which is coupled to the push lever like a seesaw and this invention performs the contact (ON) of both of the contacts by rocking of the push lever around a supporting shaft so that the bottom end of the push lever pushes immediately downward a right side piece of the seesaw contact piece to keep a state that the movable contact presses strongly and surely to the fixed contact, thereby dissolving occurrence of contact failure of the contacts and, simultaneously, producing a cleaning effect by friction of both of the contacts which come into contact with each other by flexure of the right side piece with pushing force to realize high-sophistication of switch and solve the aforementioned problems.

According to this invention, there is provided a microswitch comprising a push lever as an actuator, a seesaw contact piece to a right side piece of which a movable contact is attached, a fixed contact which switches ON or OFF by coming into contact with said movable contact or separating from said movable contact and a terminal, and a fixed contact piece supporting a corner part of the seesaw contact piece and a terminal and so on, outer peripheries thereof being enclosed with an insulating case, in which the above-described push lever is attached pivotally to the case by a supporting shaft, to a front end of which a projection is formed projecting outside the case by elastic force of a spring provided between its rear end and the case, and a lower end of which is equipped with a steel ball so as to freely roll, the seesaw contact piece comprises a left side piece and a right side piece which are formed substantially in the V-shape centered with respect to a corner part, the right side piece being provided with the movable contact, the corner part of said seesaw contact piece is supported to contact by support of an upper end of the fixed contact piece as a fulcrum so as to freely rock from right to left, and the seesaw contact piece and the fixed contact piece are made conductive and, simultaneously, the movable contact on the right side piece of the seesaw contact piece is provided opposite separately the fixed contact, and the steel ball of the above-described push lever is in contact with the left side piece of the seesaw contact piece, wherein at a free position where external force is not loaded to the projection of the push lever, the push lever rocks around the supporting shaft by the elastic force of the spring to project the projection outside the case and, simultaneously, the steel ball presses the left side piece of said seesaw contact piece to rock upward the right side piece of said seesaw contact piece with the corner part being as a fulcrum to locate the movable contact at a position separately from the fixed contact (switch OFF), said projection falls downward when the external force is loaded thereto, and the push lever rocks around the supporting shaft while compressing the spring, the steel ball rolls from the left side piece to the right side piece through the corner part while pressing the seesaw contact piece, thereby making the right side piece of the seesaw contact piece rock downward around the corner part to contact the movable contact with the fixed contact (switch ON), and when the external force is released from the projection the push lever rocks to be restored to the original state by the restoring elastic force of the spring and, simultaneously, the seesaw contact piece rocks to be restored to the original state by rolling to return the steel ball, thereby separating the movable contact from the fixed contact (switch OFF) to prepare for the original free position.

BRIEF DESCRIPTION OF THE DRAWINGS

A more complete understanding of this invention may be had by referring to the following detailed explanations in connection with the accompanying drawings, in which.

DETAILED DESCRIPTION OF THE PREFERRED EMBODIMENTS

Figure 1:
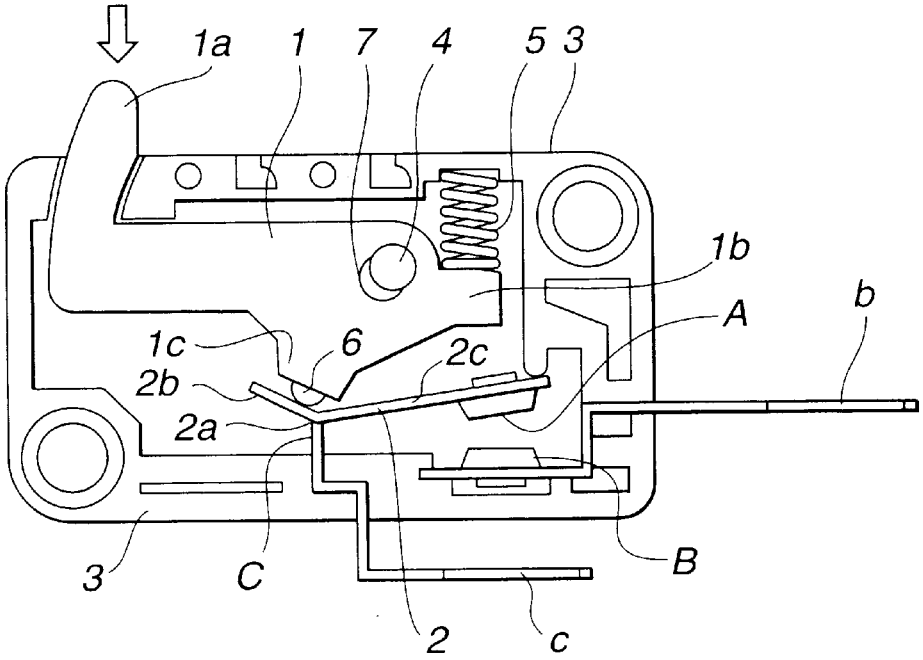
FIG. 1 is a front view of a working example of a microswitch of this invention in which a cover is removed.

Referring now to FIG. 1, working examples of this invention are described.

A microswitch of this invention comprises a push lever 1 as an actuator, a seesaw contact piece 2 equipped with a movable contact A at a right side piece 2*c*, a fixed contact B which switches ON or OFF by contacting said movable contact A or separating therefrom and a terminal b, a fixed contact piece C supporting a corner part 2*a* of the seesaw contact piece 2 and a terminal c and so on, which are enclosed with an insulating case 3.

The above-described push lever 1 having a projection 1*a* at its front is attached pivotally to the case 3 by a supporting shaft 4, said projection 1*a* being projected outside the case 3 by virtue of elastic force of a spring 5 placed between its rear end part 1*b* and the case 3, and which is provided with a steel ball 6 at its lower end part 1*c* so as to freely roll.

The seesaw contact piece 2 comprises a right side piece 2*b* and the left side piece 2*c* which is formed substantially in the V-shape centered with respect to the corner part 2*a*, said right side piece 2*c* being provided with the movable contact A.

Figure 2:
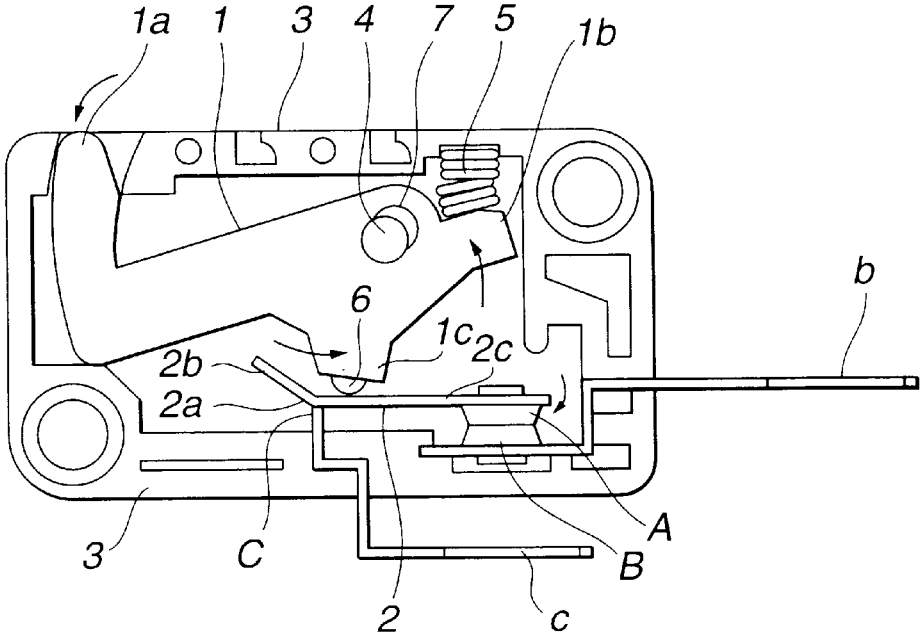
FIG. 2 is an explanatory view of the operation of FIG. 1.

As seen in FIG. 2, the corner part 2*a* of the seesaw contact piece 2 is supported by an upper end of the fixed contact piece C as a fulcrum keeping contact therewith so as to freely rock from right to left, said seesaw contact piece 2 and said fixed contact piece C being made conductive (common circuit) and, simultaneously, the movable contact A of the right piece 2*c* of the seesaw contact piece 2 is placed separately opposite the fixed contact B, and the steel ball 6 attached to the above-described push lever 1 is brought into contact with the left side piece 2*b* to form a microswitch.

A shaft hole 7 of the supporting shaft 4 by which the push lever 1 is supported pivotally is formed with play in the shape of an ellipse and so on so that the push lever 1 rocks smoothly.

The lower end part 1*c* of the push lever 1 may have a structure such that the steel ball 6 is attached thereto so as to freely roll, or a round head pin is embedded therein, or the lower end part 1*c* itself is formed in a shape of hemisphere and so on so as to project, that is to say, it may take any shape so long as it transfers smoothly, keeping in contact with an upper face of the seesaw contact piece 2 and it is excellent in abrasion resistance.

Figure 3A:
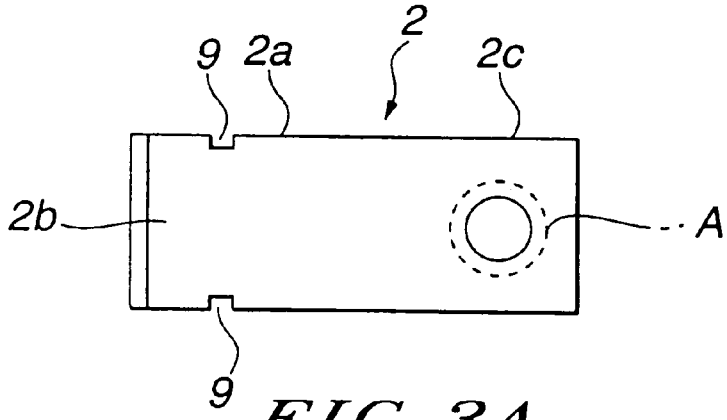
FIGS. 3A and 3B are a front view (top) and a plan view (down) of a seesaw contact piece.
Figure 3B:
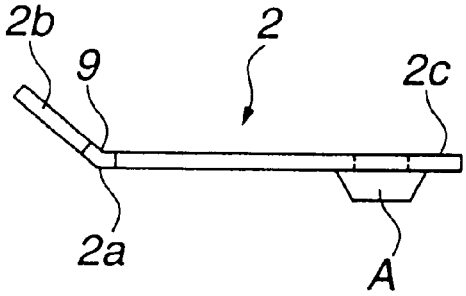
Figure 4A:
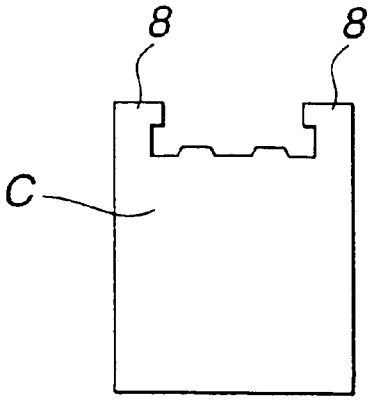
FIGS. 4A and 4B are a front view (left) and a left side view (right) of a fixed contact piece.
Figure 4B:
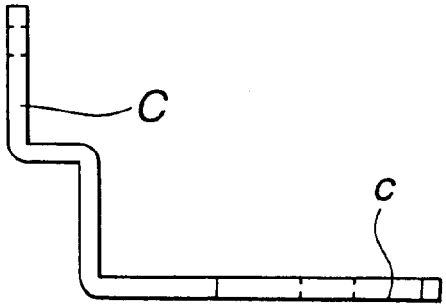

As shown in FIGS. 4A and 4B, two hook-shaped projections 8 are formed on both sides of the upper end part of the fixed contact piece C. As shown in FIGS. 3A and 3B, two recesses 9 are formed in both sides of the corner part 2*a* of the seesaw contact piece 2 and both recesses 9 of the seesaw contact piece 2 are engaged with said both hook-shaped projections 8 of the fixed contact piece C of FIGS. 4A and 4B so that said seesaw contact piece 2 of FIGS. 3A and 3B freely rocks from left to right by a support of the upper end part of the fixed contact piece C of FIG. 4B as a fulcrum so as not to come off the corner part 2*a* of FIG. 3B and so that a state of continuity (common circuit) is always maintained.

Figure 5:
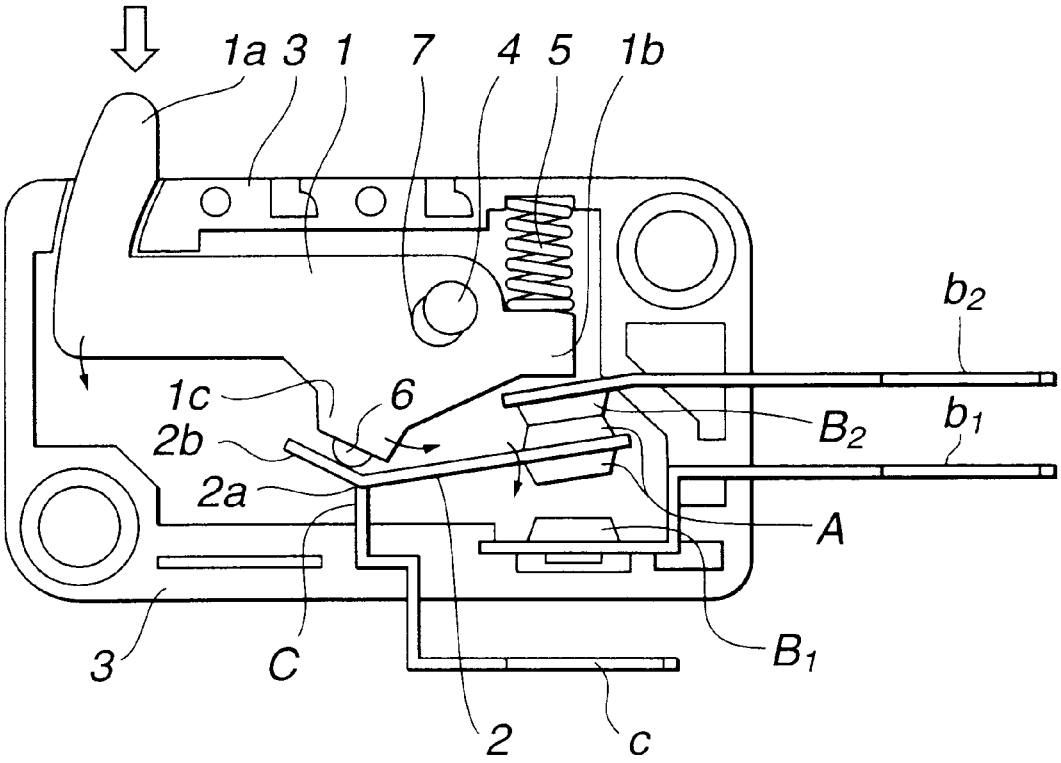
FIG. 5 is a front view of a working example in which fixed contacts are provided above and below a movable contact.

In the working example shown in FIG. 5, two fixed contacts B1 and B2 are provided above and below and opposite the movable contact A attached to the right side piece of the seesaw contact piece 2.

Figure 6:
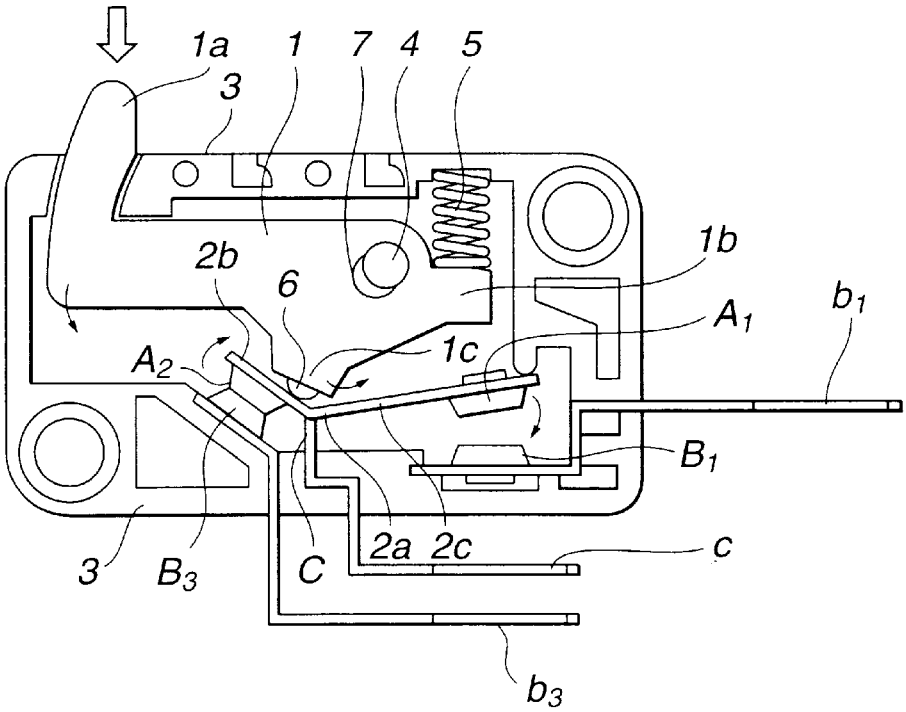
FIG. 6 is a front view of a working example in which movable contacts are provided to both of the right and left side pieces of the seesaw contact piece.

In the working example shown in FIG. 6, the movable contacts A1 and A2 are attached to both ends of the left side piece 2*b* and the right side piece 2*c* of the seesaw contact piece 2 so that they are opposite the fixed contacts B1 and B3, respectively.

Figure 7:
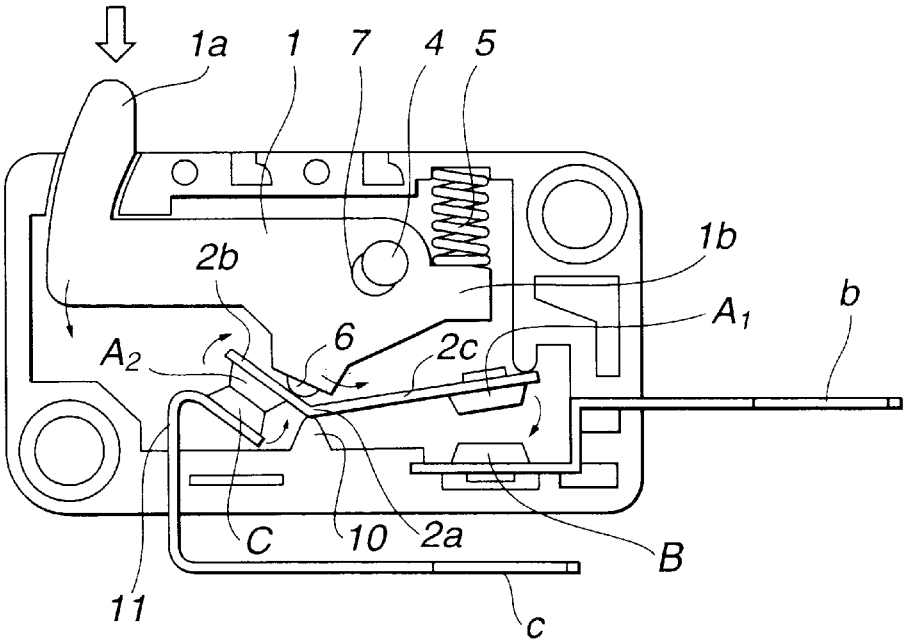
FIG. 7 is a front view of a working example in which the fixed contact piece is prepared from a spring piece and the corner part of the seesaw contact piece is supported with a projection formed in the case.

In the working example shown in FIG. 7, the corner part 2*a* of the seesaw contact piece 2 is supported by a support, projection 10 of the case instead of the upper end part of a fixed contact piece and a common circuit is formed by contacting always a contact B4 of a contact spring piece 11 with the movable contact A2 attached to the left side piece 2*b* of the seesaw contact piece 2.

According to the construction and action as described above, this invention can provide at low cost a microswitch having extremely excellent performances compared with a conventional microswitch. The invention is strong and simple in its structure, excellent in long-term durability, high-precision in performance, does not show scatter in performance for every switch and can be miniaturized.

What is claimed is:

1. A microswitch comprising:

a push lever having a ball at a lower end so as to roll freely;

a seesaw contact piece having one side piece to which a movable contact is attached and an opposite side piece to which the ball of the push lever is in constant contact when external force is not applied to the push lever;

a fixed contact which switches ON by coming into contact with the movable contact and which switches OFF by separating from the movable contact; and a fixed contact piece configured to support a corner part of the seesaw contact piece as a fulcrum.

2. A microswitch according to claim 1, further comprising:

a shaft configured to support the push lever through a shaft hole formed in a shape of an ellipse in the push lever.

3. A microswitch according to claim 1, wherein the ball is a round head pin.

4. A microswitch according to claim 1, wherein the fixed contact is provided above and below the movable contact.

5. A microswitch according to claim 1, wherein the movable contact is attached to ends of the one side piece and the opposite side piece of the seesaw contact piece.

6. A microswitch according to claim 1, wherein the fixed contact piece is a support projection.

7. A microswitch according to claim 1, wherein the seesaw contact piece has recesses formed in both sides of the corner part and the fixed contact piece has hook-shaped projections configured to engage with the recesses so that the seesaw contact piece freely rocks from one side to an opposite side.

* * * * *